US009914618B2

(12) United States Patent
Zhu et al.

(10) Patent No.: US 9,914,618 B2
(45) Date of Patent: Mar. 13, 2018

(54) METHOD AND DEVICE FOR MONITORING TENSION EQUALIZATION AND DISPLACEMENT ADJUSTMENT STATES OF STEEL WIRE ROPES OF MULTI-ROPE HOISTER

(71) Applicants: China University of Mining and Technology, Xuzhou (CN); Xuzhou Coal Mine Safety Equipment Manufacture Co., Ltd., Xuzhou (CN)

(72) Inventors: Zhencai Zhu, Xuzhou (CN); Guohua Cao, Xuzhou (CN); Gongbo Zhou, Xuzhou (CN); Changhua Hu, Xuzhou (CN); Wei Li, Xuzhou (CN); Guoan Chen, Xuzhou (CN); Yuxing Peng, Xuzhou (CN); Qingyong Du, Xuzhou (CN); Ronghua Wu, Xuzhou (CN)

(73) Assignees: China University of Mining and Technology, Xuzhou, Jiangsu (CN); Xuzhou Coal Mine Safety Equipment Manufacture Co., Ltd., Xuzhou, Jiangsu (CN)

( * ) Notice: Subject to any disclaimer, the term of this patent is extended or adjusted under 35 U.S.C. 154(b) by 22 days.

(21) Appl. No.: 14/441,440

(22) PCT Filed: Mar. 26, 2014

(86) PCT No.: PCT/CN2014/074089

§ 371 (c)(1),
(2) Date: May 7, 2015

(87) PCT Pub. No.: WO2015/043146

PCT Pub. Date: Apr. 2, 2015

(65) Prior Publication Data

US 2016/0207736 A1 Jul. 21, 2016

(30) Foreign Application Priority Data

Sep. 29, 2013 (CN) ..... 2013 1 0453372

(51) Int. Cl.

| | |
|---|---|
| ***B66B 7/10*** | (2006.01) |
| ***B66B 5/00*** | (2006.01) |
| ***B66B 7/12*** | (2006.01) |

(52) U.S. Cl.
CPC ..... *B66B 5/0025* (2013.01); *B66B 7/10* (2013.01); *B66B 7/1215* (2013.01)

(58) Field of Classification Search
CPC ..... B66B 7/10; B66B 7/1215; B66B 5/0025
(Continued)

(56) References Cited

U.S. PATENT DOCUMENTS

| | | | | |
|---|---|---|---|---|
| 6,923,599 | B2 * | 8/2005 | Kelso | E02D 35/00 187/203 |
| 2003/0141151 | A1 * | 7/2003 | Brown | B66F 7/16 187/203 |

(Continued)

FOREIGN PATENT DOCUMENTS

| | | |
|---|---|---|
| CN | 101726383 | 6/2010 |
| CN | 102020161 | 4/2011 |

(Continued)

OTHER PUBLICATIONS

International Search Report re PCT/CN2014/074089, dated Jun. 24, 2014, 6 pgs.

*Primary Examiner* — David Warren
(74) *Attorney, Agent, or Firm* — Greenberg Traurig, LLP

(57) ABSTRACT

A device for monitoring tension equalization and displacement adjustment states of steel wire ropes of a multi-rope hoister includes a displacement sensor mounted on a steel wire rope tension equalization device, a signal acquisition transmitter designed to store and transmit signals of the displacement sensor, a barometric altimeter designed to detect the depth of a mine shaft where a hoisting container is located, and a wireless receiving and processing system arranged at the well mouth of the mine shaft. A method for use includes collecting the displacement adjustment amounts of the tension equalization devices connected with all the hoisting ropes of the hoisting container and the corresponding depth position of the hoisting container during the up-down running process of the hoisting container by means of the signal acquisition transmitter; judging the maximum displacement adjustment amount measured in the
(Continued)

entire hoisting process and the corresponding tension adjustment device and corresponding depth, by receiving and processing data via the wireless receiving and processing system; and, giving an alarm when the maximum adjusted displacement is greater than a preset adjustment threshold.

2 Claims, 3 Drawing Sheets

(58) Field of Classification Search
USPC ..... 187/247
See application file for complete search history.

(56) References Cited

U.S. PATENT DOCUMENTS

2009/0014242 A1* 1/2009 Tang ..... H04Q 9/00 182/241
2010/0088908 A1* 4/2010 Matzker ..... G01C 5/06 33/282
2012/0000733 A1* 1/2012 Finschi ..... B66B 1/2458 187/382
2012/0051449 A1* 3/2012 Bunter ..... B66B 5/0087 375/259
2012/0118677 A1* 5/2012 Finschi ..... B66B 1/2408 187/384
2015/0284214 A1* 10/2015 Park ..... B66B 5/0018 187/393
2016/0174334 A1* 6/2016 Anthony ..... H05B 37/0227 315/153
2016/0272460 A1* 9/2016 Simcik ..... B66B 1/468
2017/0029244 A1* 2/2017 Madarasz ..... B66B 5/0037

FOREIGN PATENT DOCUMENTS

CN 102398834 4/2012
CN 103538989 1/2014
CN 103538989 A * 1/2014 ..... B66B 7/10
CN 203545396 4/2014
JP 11209032 8/1999
JP 2008162782 7/2008

* cited by examiner

METHOD AND DEVICE FOR MONITORING TENSION EQUALIZATION AND DISPLACEMENT ADJUSTMENT STATES OF STEEL WIRE ROPES OF MULTI-ROPE HOISTER

CROSS REFERENCE TO RELATED APPLICATION

The present application is a 371 U.S. National Stage of International Application No. PCT/CN2014/074089, filed Mar. 26, 2014, which claims the benefit of the earlier filing date of Chinese Patent Application No. 201310453372.5 filed on Sep. 29, 2013, which are each incorporated herein by reference in their entirety.

FIELD OF THE INVENTION

The present invention relates to a method and a device for monitoring tension equalization and displacement adjustment states of steel wire ropes of a multi-rope hoister, which are especially suitable for measuring the adjustment amount of hoisting steel wire ropes with a self-adapting tensioning device for multiple friction hoisting steel wire ropes in a mine vertical shaft.

BACKGROUND OF THE INVENTION

In a mine vertical shaft hoisting system, the large-size hoisting containers such as cage and skip are suspended and hoisted by multiple steel wire ropes. To prevent unbalanced stress on the hoisting steel wire ropes owing to tension inconsistency among multiple steel wire ropes, usually an automatic tension equalizing suspension device is added at the joint between the top of the hoisting container and the steel wire ropes. At present, the adjustment states of the steel wire ropes adjusted by each tension equalization device, including whether real-time automatic adjustment can be made or not, whether the adjustment amount is greater than the maximum adjustment range or not, etc., have to be observed manually, resulting in waste of time and labor. No device or method that can carry out such measurement automatically is available yet.

SUMMARY OF THE INVENTION

Technical problem: to detect the adjustment states of steel wire ropes adjusted by a steel wire rope tension equalization device for a multi-rope hoister, the present invention provides a method and a device for monitoring tension equalization and displacement adjustment states of steel wire ropes of a multi-rope hoister, which are easy to implement and can provide highly accurate measurement results.

Technical scheme: the device for monitoring tension equalization and displacement adjustment states of steel wire ropes of a multi-rope hoister provided in the present invention comprises a ground wireless receiving and processing system, tension equalization devices, multiple hoisting steel wire ropes for hoisting a hoisting container, and a hoisting container pulling plate provided on the top of the hoisting container, wherein, multiple tension equalization devices are arranged at an interval on the hoisting container pulling plate and fixed to the hoisting steel wire ropes respectively, and each tension equalization device is provided with a displacement sensor thereon; a barometric altimeter and a signal acquisition transmitter connected with the barometric altimeter are arranged on a side wall of the hoisting container, and each displacement sensor is connected with the signal acquisition transmitter through conductive wires; the displacement sensors are pull-rod displacement sensors, and the extension rod of each sensor is hinged to a wedge-shaped rope ring of the tension equalization device via a bolt; the enclosure of each sensor is fixed to a side plate of the tension equalization device by screws.

The method for monitoring tension equalization and displacement adjustment states of steel wire ropes of a multi-rope hoister with the device described above is:

before the hoisting container runs at the well mouth, the initial adjustment amounts of the tension equalization devices are measured by the displacement sensors, the signals of which are transmitted to the signal acquisition transmitter, the signal acquisition transmitter transmits the acquired signals to the wireless receiving and processing system, and the wireless receiving and processing system sets an adjustment threshold for each tension equalization device according to the initial adjustment amount of the tension equalization device;

during the up-down running process and the loading and unloading process of the hoisting container in the mine shaft, the displacement amounts to be adjusted are different among different hoisting steel wire ropes since the tensions on the multiple hoisting steel wire ropes are different; thus, the tension equalization device fixed on each hoisting steel wire rope adjusts the displacement amount of the hoisting steel wire rope respectively, the extension rod of the displacement sensor arranged on each tension equalization device moves up and down along with the wedge-shaped rope ring connected with the hoisting steel wire rope, and thereby sends the displacement signal to the signal acquisition transmitter; meanwhile, the barometric altimeter measures the depth of the hoisting container in the mine shaft, and transmits the measured data to the signal acquisition transmitter; the signal acquisition transmitter acquires the data from the barometric altimeter and the data from the displacement sensors in real time, and stores the displacement adjustment amounts of the tension equalization devices and the corresponding depth value of the hoisting container in the mine shaft; then, the signal acquisition transmitter transmits the acquired data to the wireless receiving and processing system, the wireless receiving and processing system processes the received data, outputs the displacement adjustment amount of the tension equalization device connected with each hoisting steel wire rope and the corresponding depth data of the hoisting container in the mine shaft during the up-down running process and the loading and unloading process of the hoisting container in the mine shaft, and judges the maximum displacement adjustment amount of each tension adjustment device and the corresponding depth of the tension adjustment device in the entire hoisting process; if the maximum displacement adjustment amount is greater than the preset adjustment threshold, the wireless receiving and processing system will give an alarm.

Beneficial effects: Compared with the prior art, the present invention has the following advantages:

(1) The device and method provided in the present invention can monitor the adjustment states adjusted by the tension equalization devices in the entire hoisting process; thus, an effective monitoring method for monitoring normal run state and abnormal run state is provided, and the problem of time-consuming and labor-intensive manual observation is settled;

(2) Since the displacement adjustment amounts of the automatic equalization devices and the corresponding depth value of the hoisting container are monitored and stored, useful positional information can be provided for ascertaining the cause for tension imbalance on the hoisting steel wire ropes.

(3) Since an alarm can be given in case the output of maximum displacement goes beyond the permissible adjustment range, the operating safety and reliability of the hoisting system is improved.

Figure 1:
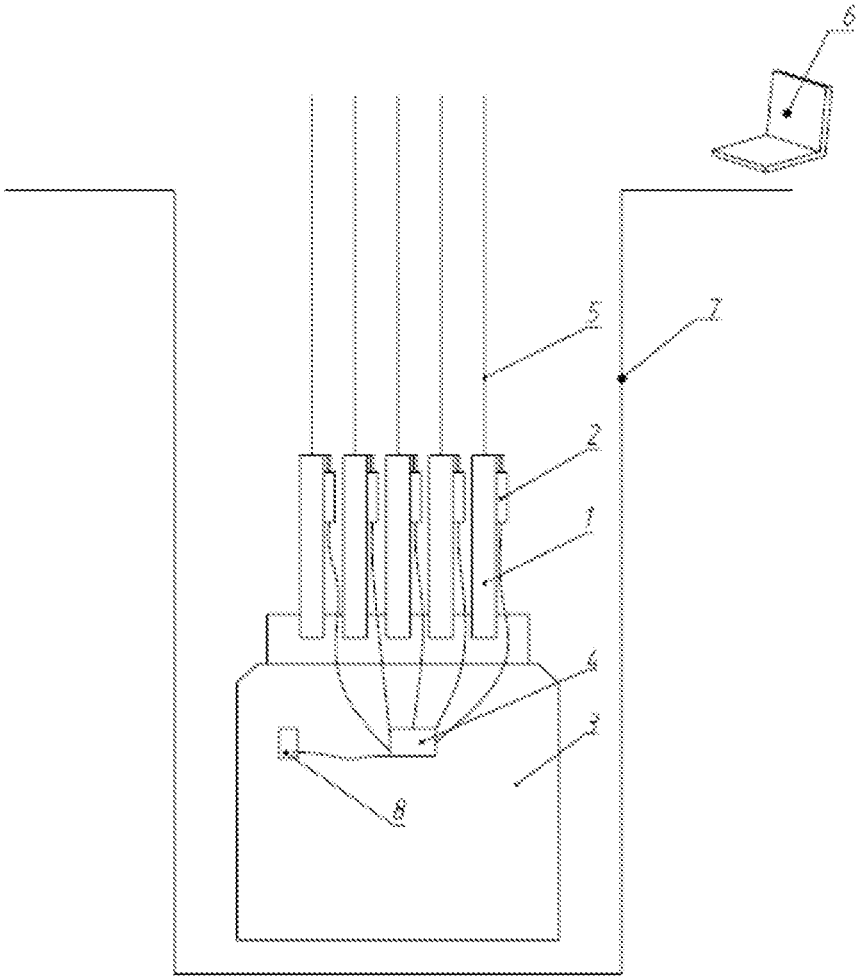
FIG. 1 is a schematic structural diagram of the present invention.

Among the figures: 1—tension equalization device, 1-1—wedge-shaped rope ring, 1-2—side plate, 1-3—hydraulic oil cylinder, 2—displacement sensor, 2-1—extension rod, 2-2—enclosure, 3—hoisting container, 3-1—hoisting container pulling plate, 4—signal acquisition transmitter, 5—hoisting steel wire rope, 6—wireless receiving and processing system, 7—mine shaft, 8—barometric altimeter

DETAILED DESCRIPTION OF THE EMBODIMENTS

Hereunder the present invention will be further detailed in an embodiment, with reference to the accompanying drawings:

The device for monitoring tension equalization and displacement adjustment states of steel wire ropes of a multi-rope hoister in the present invention mainly comprises: tension equalization devices 1, displacement sensor 2, a signal acquisition transmitter 4, hoisting steel wire ropes 5, and a barometric altimeter 8, all of which are arranged in a mine shaft 7 and fixed to a hoisting container 3, and a wireless receiving and processing system 6 arranged on the ground; a hoisting container pulling plate 3-1 is provided on the top of the hoisting container 3, multiple tension equalization devices 1 are arranged at an interval on the hoisting container pulling plate 3-1 and are fixed to multiple hoisting steel wire ropes 5 respectively, and each tension equalization device 1 is provided with a displacement sensor 2 thereon respectively; the barometric altimeter 8 and the signal acquisition transmitter 4 connected with the barometric altimeter 8 are arranged on a side wall of the hoisting container 3, and the displacement sensors 2 are connected with the signal acquisition transmitter 4 via conductive wires respectively; the displacement sensors 2 are pull-rod displacement sensors, and the extension rod 2-1 of each sensor 2 is hinged to a wedge-shaped rope ring 1-1 of the tension equalization device 1 via a bolt; the enclosure 2-2 of each sensor 2 is fixed to a side plate 1-2 of the tension equalization device 1 by screws.

Figure 2:
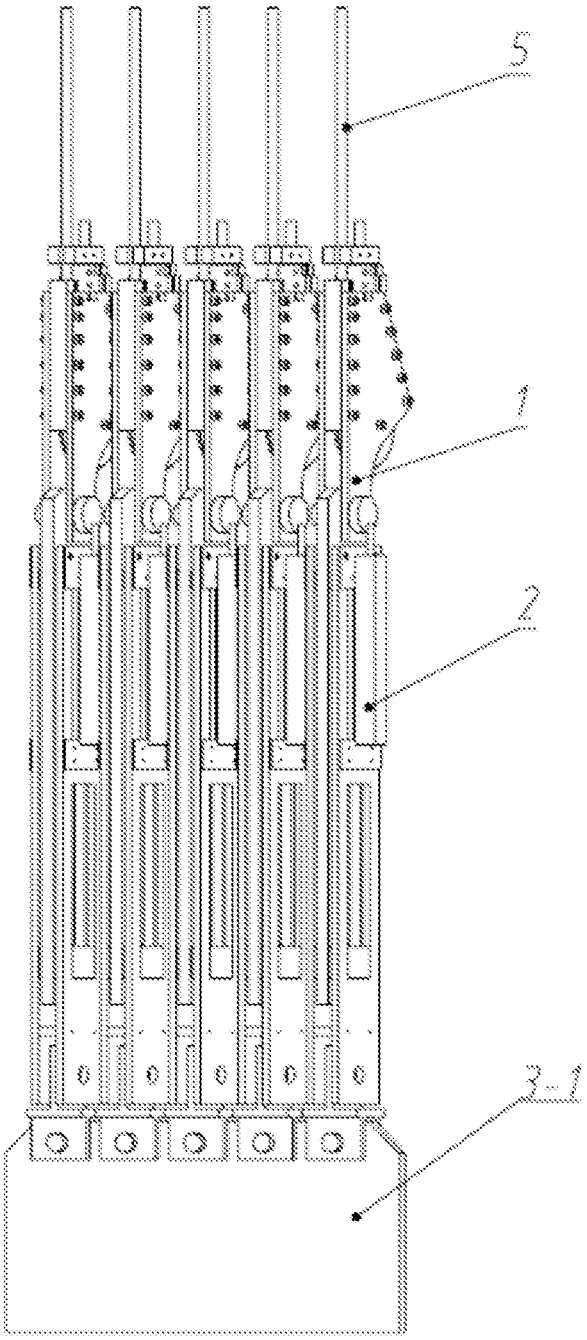
FIG. 2 is a schematic structural diagram of the multi-rope hoisting suspension device in the present invention.

As shown in FIG. 1 and FIG. 2, the hoisting container 3 is suspended by multiple steel wire ropes 5 in the mine shaft 7 and runs up and down in the mine shaft 7, the wedge-shaped rope ring 1-1 of the tension equalization device 1 is connected with the hoisting steel wire rope 5, the side plate 1-2 is connected with the hoisting container pulling plate 3-1 via a dowel pin, and the hoisting container pulling plate 3-1 and the hoisting container 3 are fixedly connected with each other. The displacement sensor 2 is mounted on the tension equalization device 2, the extension rod 2-1 of the displacement sensor 2 is connected with the wedge-shaped rope ring 1-1, and the enclosure 2-2 is fixedly connected with the side plate 1-2. The barometric altimeter 8 is mounted on the upper part of the hoisting container 3, and is used to detect the depth of the hoisting container 3 in the mine shaft and thereby obtain the depth of the hoisting container 3 corresponding to a specific displacement adjustment amount of the tension equalization device 1. The signal acquisition transmitter 4 acquires and analyzes the signals from the displacement sensors 2 and the barometric altimeter 8, and stores the displacement adjustment mounts of the tension equalization devices 1 and the corresponding depth value; the wireless receiving and processing system 6 is arranged at the well mouth of the mine shaft 7; when the hoisting container 3 is hoisted to the well mouth of the mine shaft 7, the signal acquisition transmitter 4 will transmit the acquired data by wireless transmission to the wireless receiving and processing system 6, the wireless receiving and processing system 6 will process the received data, and output the displacement adjustment amounts of the tension equalization devices 1 connected with the hoisting ropes in the up-down running process of the hoisting container 2 in the mine shaft, the displacement adjustment amounts in the loading and unloading process, and corresponding depth values of the hoisting container.

Figure 3:
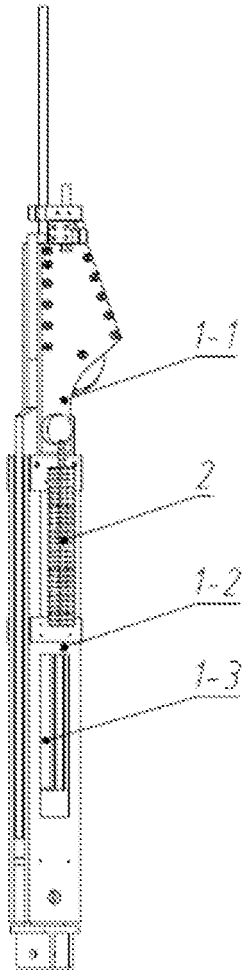
FIG. 3 is a schematic position structural diagram of the displacement sensor on the tension equalization device in the present invention.
Figure 4:
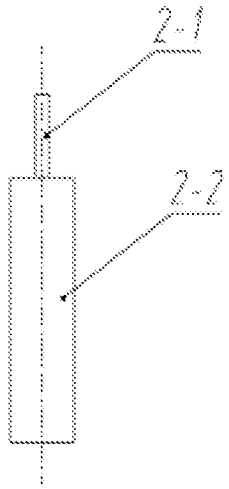
FIG. 4 is a schematic structural diagram of the pull-rod displacement sensor in the present invention.

As shown in FIG. 3 and FIG. 4, when the tension on the hoisting steel wire rope 5 changes, the tension equalization device 1 will adjust the tension on the hoisting steel wire rope 5, i.e., the tension equalization device 1 will adjust the tension on the hoisting steel wire rope 5 by moving its hydraulic oil cylinder 1-3 up or down. Since the extension rod 2-1 of the displacement sensor 2 is fixedly connected with the wedge-shaped rope ring 1-1, the displacement amount of the extension rod 2-1 is the displacement amount of the wedge-shaped rope ring 1-1 relative to the hoisting container 3, i.e., the adjustment amount adjusted by the tension equalization device 1 for the hoisting steel wire rope 5.

The method for monitoring tension equalization and displacement adjustment states of steel wire ropes of a multi-rope hoister with the device described above is:

before the hoisting container 3 runs at the well mouth (i.e., in zero load state at the well mouth), the initial adjustment amount of the tension equalization device 1 is measured by the displacement sensor 2, the signal is transmitted to the signal acquisition transmitter 4, the signal acquisition transmitter 4 transmits the acquired signal to the wireless receiving and processing system 6, and the wireless receiving and processing system 6 sets an adjustment threshold for the tension equalization device 1 according to the initial adjustment amount of the tension equalization device 1;

during the up-down running process and loading and unloading process of the hoisting container 3 in the mine shaft 7, since the tensions on different hoisting steel wire ropes 5 are different, the amounts of displacement adjustment to be adjusted are different among the hoisting steel wire ropes 5; the tension equalization device 1 fixed to each hoisting steel wire rope 5 adjusts the tension on the hoisting steel wire rope 5 by extending or retracting an hydraulic oil cylinder 1-3 in the tension equalization device, according to the tension on the hoisting steel wire rope 5, so as to control the displacement amount; the extension rod 2-1 of the displacement sensor 2 on each tension equalization device 1 moves up and down along with the wedge-shaped rope ring 1-1 connected with the hoisting steel wire rope 5, and thereby transmits the displacement signal to the signal acquisition transmitter;

Meanwhile, the barometric altimeter 8 measures the depth of the hoisting container in the mine shaft 7, and thereby obtains the depth of the hoisting container 3 in the mine shaft 7 when the adjustment amount of the tension equalization device 1 is measured, and the barometric altimeter 8 transmits the measured data to the signal acquisition transmitter 4; the signal acquisition transmitter 4 acquires the data from the barometric altimeter 8 and the displacement sensors 2 in real time, and stores the displacement adjustment amounts of the tension equalization devices 1 and the corresponding depth of the hoisting container 3 in the mine shaft 7; when the hoisting container 3 is hoisted to the well mouth of the mine shaft 7, the signal acquisition transmitter 4 transmits the acquired data to the wireless receiving and processing system 6; the wireless receiving and processing system 6 processes the received data, outputs the displacement adjustment amount of the tension equalization device 1 connected with each hoisting steel wire rope 5 and the corresponding depth data of the hoisting container in the mine shaft 7 during the up-down running process and the loading and unloading process of the hoisting container 3, and judges the maximum amount of displacement adjustment adjusted in the entire hoisting process and the depth of the tension adjustment device corresponding to the maximum amount of displacement adjustment; if the maximum amount of displacement adjustment is greater than the preset adjustment threshold, the wireless receiving and processing system 6 will give an alarm.

The invention claimed is:

1. A device for monitoring tension equalization and displacement adjustment states of steel wire ropes of a multi-rope hoister, comprising:

a ground wireless receiving and processing system;

multiple tension equalization devices;

multiple hoisting steel wire ropes for hoisting a hoisting container; and a hoisting container pulling plate provided on the top of the hoisting container, multiple tension equalization devices are arranged at an interval on the hoisting container pulling plate and fixed to the hoisting steel wire ropes respectively, wherein, each of the tension equalization device is provided with a displacement sensor thereon;

a barometric altimeter and a signal acquisition transmitter connected with the barometric altimeter are arranged on a side wall of the hoisting container, and each displacement sensor is connected with the signal acquisition transmitter through conductive wires;

the displacement sensors are pull-rod displacement sensors, and an extension rod of each sensor is hinged to a wedge-shaped rope ring of the tension equalization device via a bolt;

the enclosure of each sensor is fixed to a side plate of the tension equalization device by screws.

2. A method for monitoring the tension equalization and displacement adjustment states of steel wire ropes of a multi-rope hoister with a monitoring device including:

a ground wireless receiving and processing system;

multiple tension equalization devices, each of the tension equalization device provided with a displacement sensor thereon;

multiple hoisting steel wire ropes for hoisting a hoisting container; and a hoisting container pulling plate provided on the top of the hoisting container, multiple tension equalization devices are arranged at an interval on the hoisting container pulling plate and fixed to the hoisting steel wire ropes respectively, a barometric altimeter and a signal acquisition transmitter connected with the barometric altimeter are arranged on a side wall of the hoisting container, and each displacement sensor is connected with the signal acquisition transmitter through conductive wires;

the displacement sensors are pull-rod displacement sensors, and an extension rod of each sensor is hinged to a wedge-shaped rope ring of the tension equalization device via a bolt the enclosure of each sensor is fixed to a side plate of the tension equalization device by screws;

the method comprising:

measuring an initial adjustment amount of one of the tension equalization device before the hoisting container runs at a well mouth, wherein the initial adjustment amount of the tension equalization device is measured by the displacement sensor, transmitting a signal to the signal acquisition transmitter, wherein the signal acquisition transmitter transmits the acquired signal to the wireless receiving and processing system, and the wireless receiving and processing system sets an adjustment threshold for the tension equalization device according to the initial adjustment amount of the tension equalization device;

adjusting a displacement amount of the hoisting steel wire rope during operation and a loading and unloading process of the hoisting container in a mine shaft, because an amount of tension on each different hoisting steel wire ropes is different, the amounts of displacement adjustment to be adjusted are different among the hoisting steel wire ropes, wherein the tension equalization device fixed to each hoisting steel wire rope adjusts the displacement amount of the hoisting steel wire rope according to the tension on the hoisting steel wire rope and the extension rod of the displacement sensor on each tension equalization device moves up and down along with the wedge-shaped rope ring connected with the hoisting steel wire rope and thereby transmits the displacement signal to the signal acquisition transmitter;

measuring a depth of the hoisting container in the mine shaft via the barometric altimeter transmitting a measured data to the signal acquisition transmitter wherein the signal acquisition transmitter acquires the data from the barometric altimeter and the displacement sensors in real time, and stores the displacement adjustment amounts of the tension equalization devices and the corresponding depth of the hoisting container in the mine shaft and then transmits the acquired data to the wireless receiving and processing system wherein the wireless receiving and processing system processes the received data, outputs the displacement adjustment amount of the tension equalization device connected with each hoisting steel wire rope and the corresponding depth data of the hoisting container in the mine shaft during the up-down running process and the loading and unloading process of the hoisting container and judges a maximum amount of displacement adjustment adjusted in the entire hoisting process and the depth of the tension adjustment device corresponding to the maximum amount of displacement adjustment; and the wireless receiving and processing system proving an alarm if the maximum amount of displacement adjustment is greater than the preset adjustment threshold.

* * * * *